US006956452B2

(12) United States Patent
Kumar et al.

(10) Patent No.: US 6,956,452 B2
(45) Date of Patent: Oct. 18, 2005

(54) APPARATUS AND METHOD FOR CIRCUIT BREAKER TRIP UNIT ADJUSTMENT

(75) Inventors: Navin Kumar, Karnataka (IN); Ronald Ciarcia, Bristol, CT (US); Narender Macha, Hyderabad (IN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 10/671,347

(22) Filed: Sep. 24, 2003

(65) Prior Publication Data

US 2005/0062568 A1 Mar. 24, 2005

(51) Int. Cl.[7] ..... B01H 9/00
(52) U.S. Cl. ..... 335/176; 335/42
(58) Field of Search ..... 335/23–25, 35–42, 335/165–177, 255–256, 273

(56) References Cited

U.S. PATENT DOCUMENTS

| | | | | |
|---|---|---|---|---|
| 3,588,761 A | | 6/1971 | Heft et al. | 335/16 |
| 3,593,234 A | | 7/1971 | Charbonneau et al. | 335/176 |
| 3,797,007 A | * | 3/1974 | Salvati et al. | 335/176 |
| 3,908,110 A | | 9/1975 | Heft | 219/121 |
| 3,949,331 A | * | 4/1976 | Cellerini et al. | 335/45 |
| 4,399,421 A | * | 8/1983 | MacLean | 335/174 |
| 4,860,435 A | | 8/1989 | Powell | 29/622 |
| 4,939,492 A | * | 7/1990 | Raso et al. | 335/42 |
| 5,821,839 A | | 10/1998 | Heise et al. | 335/35 |

FOREIGN PATENT DOCUMENTS

| | | | |
|---|---|---|---|
| EP | 0913848 | 5/1999 | H01H/71/74 |
| JP | 11003647 A | 1/1999 | H01H/71/74 |
| JP | 11102634 A | 4/1999 | H01H/73/02 |
| JP | 11329200 A | 11/1999 | H01H/73/06 |
| WO | 8803336 A1 | 5/1998 | H02H/3/08 |

* cited by examiner

*Primary Examiner*—Lincoln Donovan
(74) *Attorney, Agent, or Firm*—Cantor Colburn LLP

(57) ABSTRACT

A trip system for a circuit breaker having a calibration system is disclosed. The calibration system includes a retainer, a tripping member responsive to an electric current, an actuator retained by the retainer, a spring adjuster adjustably engaged with the actuator and the tripping member, and a bias spring disposed for biasing the actuator in a first direction. Movement of the spring adjuster absent movement of the actuator and the tripping member results in a change in the bias spring force and no change in the position of the tripping member, and movement of the tripping member absent movement of the spring adjuster results in a change in the position of the tripping member and no change in the bias spring force.

11 Claims, 5 Drawing Sheets

APPARATUS AND METHOD FOR CIRCUIT BREAKER TRIP UNIT ADJUSTMENT

BACKGROUND OF THE INVENTION

The present disclosure relates generally to a trip system for a circuit breaker, and particularly to an apparatus and method for adjusting a trip unit of the trip system.

Electrical circuit breakers may employ a variety of trip units for sensing an electrical current and for initiating a tripping action at the circuit breaker, including bimetallic, magnetic, and thermal/magnetic trip units. Magnetic trip units may include c-shaped magnets, oil-filled dashpots, coil-type solenoids, and the like. Circuit breaker manufacturing processes employing such trip units may include a calibration routine to properly coordinate the responsiveness of the trip unit to an electrical current and to properly adjust for dimensional variations and tolerances among and between the circuit breaker components. One such calibration routine involves the setting of different parameters, such as a magnetic air gap and a mechanical air gap for example. However, the adjustment of one parameter may effect the adjustment of another parameter, which may then need to be readjusted. Accordingly, there is a need in the art for a trip system for a circuit breaker that overcomes these drawbacks.

SUMMARY OF THE INVENTION

In one embodiment, a trip system for a circuit breaker having a calibration system is disclosed. The calibration system includes a retainer, a tripping member responsive to an electric current, an actuator retained by the retainer, a spring adjuster adjustably engaged with the actuator and the tripping member, and a bias spring disposed for biasing the actuator in a first direction. Movement of the spring adjuster absent movement of the actuator and the tripping member results in a change in the bias spring force and no change in the position of the tripping member, and movement of the tripping member absent movement of the spring adjuster results in a change in the position of the tripping member and no change in the bias spring force.

In another embodiment, a trip system for a circuit breaker having a calibration system is disclosed. The calibration system includes a bias spring for defining a trip force, a tripping member responsive to a magnetic flux across an air gap for overcoming the trip force and for generating a trip displacement, means for adjusting the trip force in the absence of adjustment to the air gap, and means for adjusting the air gap in the absence of adjustment to the trip force.

In a further embodiment, a method for calibrating a trip unit of a circuit breaker is disclosed. The position of a spring adjuster is fixed to prevent a change in trip force, the position of a tripping member is adjusted to change the dimension of a first air gap at the trip unit, the position of the tripping member is fixed to prevent any further change in the first air gap, the position of an actuator is fixed to prevent a change in a second air gap at the trip unit, and the position of the spring adjuster is adjusted to change the trip force.

BRIEF DESCRIPTION OF THE DRAWINGS

Referring to the exemplary drawings wherein like elements are numbered alike in the accompanying Figures.

DETAILED DESCRIPTION OF THE INVENTION

An embodiment of the invention provides a trip system for a circuit breaker. While the embodiment described herein depicts a magnetic trip unit as an exemplary trip system, it will be appreciated that the disclosed invention is also applicable to other trip systems, such as a bimetallic or a thermal/magnetic trip unit for example.

Figure 1:
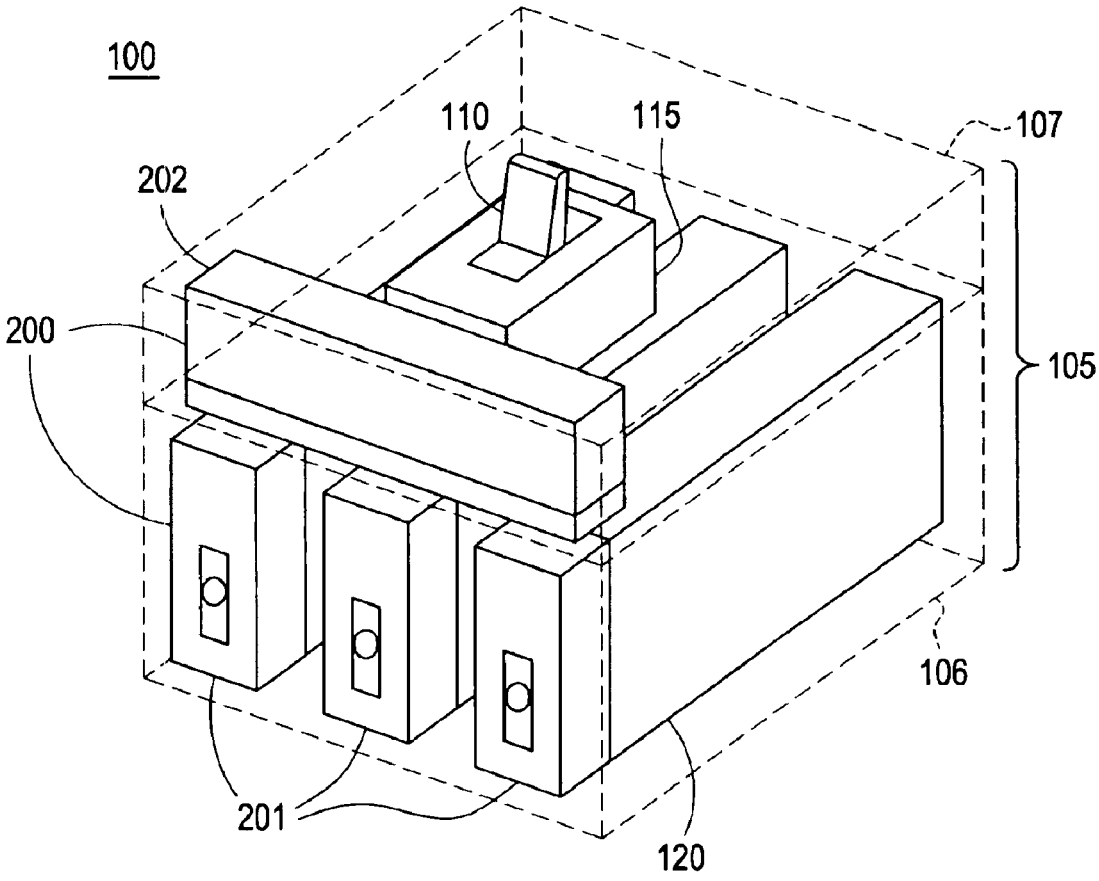
FIG. 1 depicts an exemplary circuit breaker for employing an embodiment of the invention.

FIG. 1 is an exemplary embodiment of a circuit breaker 100 having a housing 105, an operating handle 110 connected to an operating mechanism 115 for opening and closing a current path 120, and a trip system 200 for responding to a current in current path 120 to initiate an opening action at operating mechanism 115. While FIG. 1 depicts a three-phase circuit breaker 100 having individual current sensors 201, such as trip units 300 discussed later, and a common interface 202, such as crossbar 210 and trip bar 225 discussed later, it will be appreciated that single-phase and two-pole circuit breaker constructions may also employ an embodiment of the invention.

Figure 2:
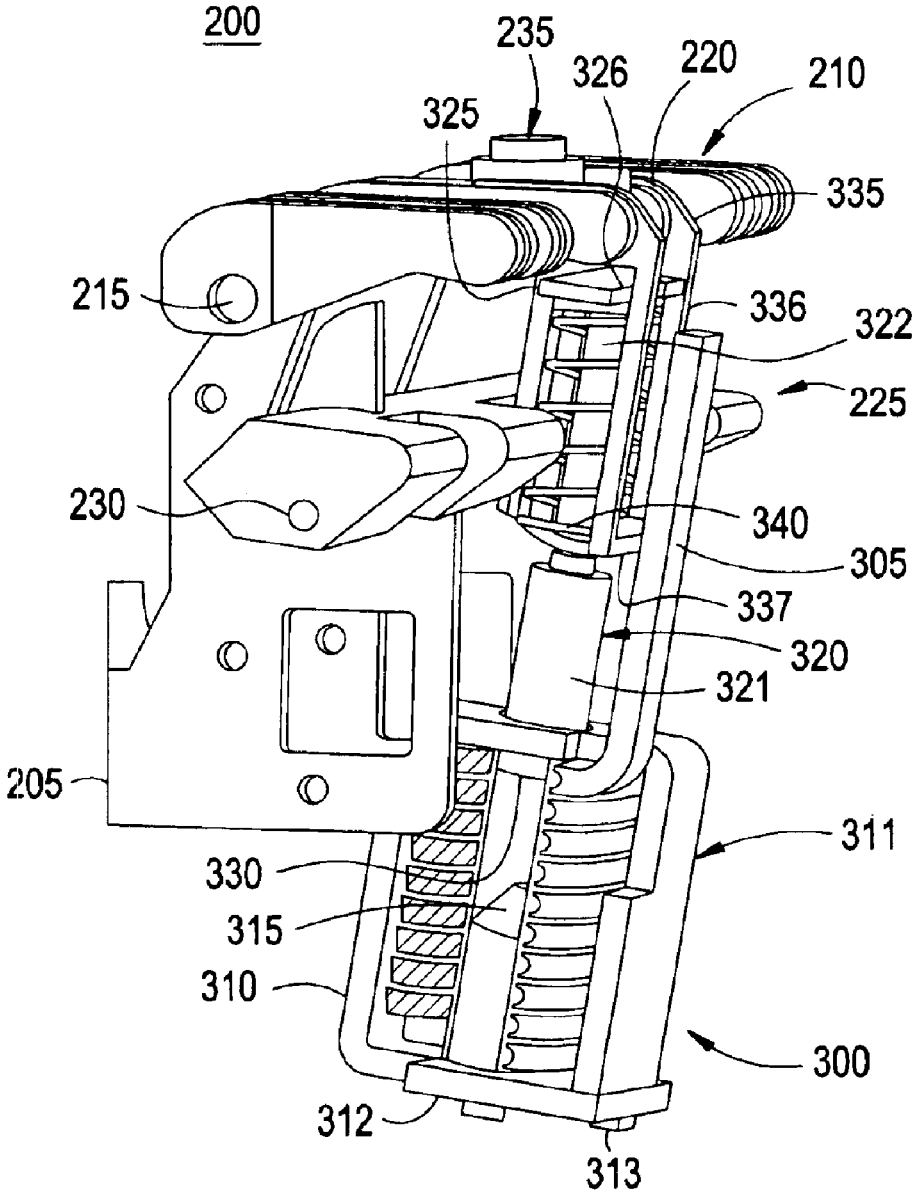
FIG. 2 depicts an isometric view of a trip system in accordance with an embodiment of the invention.

Trip system 200, best seen by now referring to FIG. 2, includes a support frame 205 for providing a common support for the various components of trip system 200, a trip unit 300 responsive to an electric current for generating a magnetic flux that is utilized to generate a trip force and a trip displacement, a crossbar 210 directly coupled to support frame 205 at pivot 215 and directly coupled to trip unit 300 at pivot 220, and a trip bar 225 directly coupled to support frame 205 at pivot 230. By directly and pivotally coupling crossbar 210 to support frame 205, the dimensional positioning of crossbar 210 may be tightly controlled relative to other parts employing support frame 205 as a datum, while providing a degree of freedom therebetween. As used herein, the term "degree of freedom" refers to a degree of freedom of motion in one or more directions, which may be translational or rotational as depicted and described. Crossbar 210 is also directly and pivotally coupled to trip unit 300, which provides a degree of freedom therebetween with dimensional control. By directly and pivotally coupling trip bar 225 to support frame 205, a degree of freedom is provided therebetween with the dimensional positioning of trip bar 225 relative to crossbar 210 and trip unit 300 being tightly controlled. Trip bar 225 is responsive to the trip force and trip displacement generated at trip unit 300, which is discussed further later. During the operation of trip system 200, discussed in more detail later, an electric current at trip unit 300 generates a trip force and trip displacement that acts upon trip bar 225 to trip operating mechanism 115 of circuit breaker 100 to open current path 120, with the crossbar 210 remaining substantially stationary during the tripping action.

Trip unit 300 includes a trip coil 305 for accepting an electric current and for generating a magnetic flux in response thereto, a flux path 310 arranged proximate trip coil 305 for concentrating the magnetic flux and directing it to a stationary pole face 315, and a tripping member 320 having a first end 321 responsive to the magnetic flux of the electric current and a second end 322 having an actuator 325 for interacting with trip bar 225. In an embodiment, tripping member 320 is slidably arranged within the center of trip coil 305 and includes a movable pole face 330 at first end 321 that magnetically interacts with stationary pole face 315.

In an embodiment, flux path 310 may be fabricated from two flux paths; an upper flux path 311 and a lower flux path 312, having a flux bridge via a tab or dovetail connection 313. In this manner, the assembly of trip coil 305 and flux path 310 may be more easily assembled. Furthermore, upper flux path 311 may be fabricated with a drawn hole through which tripping member 320 axially translates, thereby improving the flux distribution between upper flux path 311 and tripping member 320, and reducing the reluctance across the air gap thereat.

Trip unit 300 also includes a cage 335 pivotally coupled to crossbar 210 at pivot 220, as discussed previously, which includes side legs 336 for housing bias spring 340, and a bottom section 337 for slidably engaging with tripping member 320. Accordingly, cage 335 and tripping member 320 are coupled together with a degree of freedom therebetween. Actuator 325 is threadably engaged with second end 322 of tripping member 320, thereby enabling adjustment therebetween, discussed further later. Corners 326 of actuator 325 slidably engage with side legs 336 of cage 335, thereby preventing rotation of actuator 325 as tripping member 320 is rotated, discussed further later, while providing a degree of freedom between actuator 325 and cage 335. In an embodiment, bias spring 340 is a compression spring, which is captivated between actuator 325 and bottom section 337 of cage 335, and which contributes to the trip force that needs to be overcome before circuit breaker 100 trips. Accordingly, bias spring 340 biases tripping member 320 and actuator 325 upward (a first direction), as depicted in FIG. 2.

Figure 3:
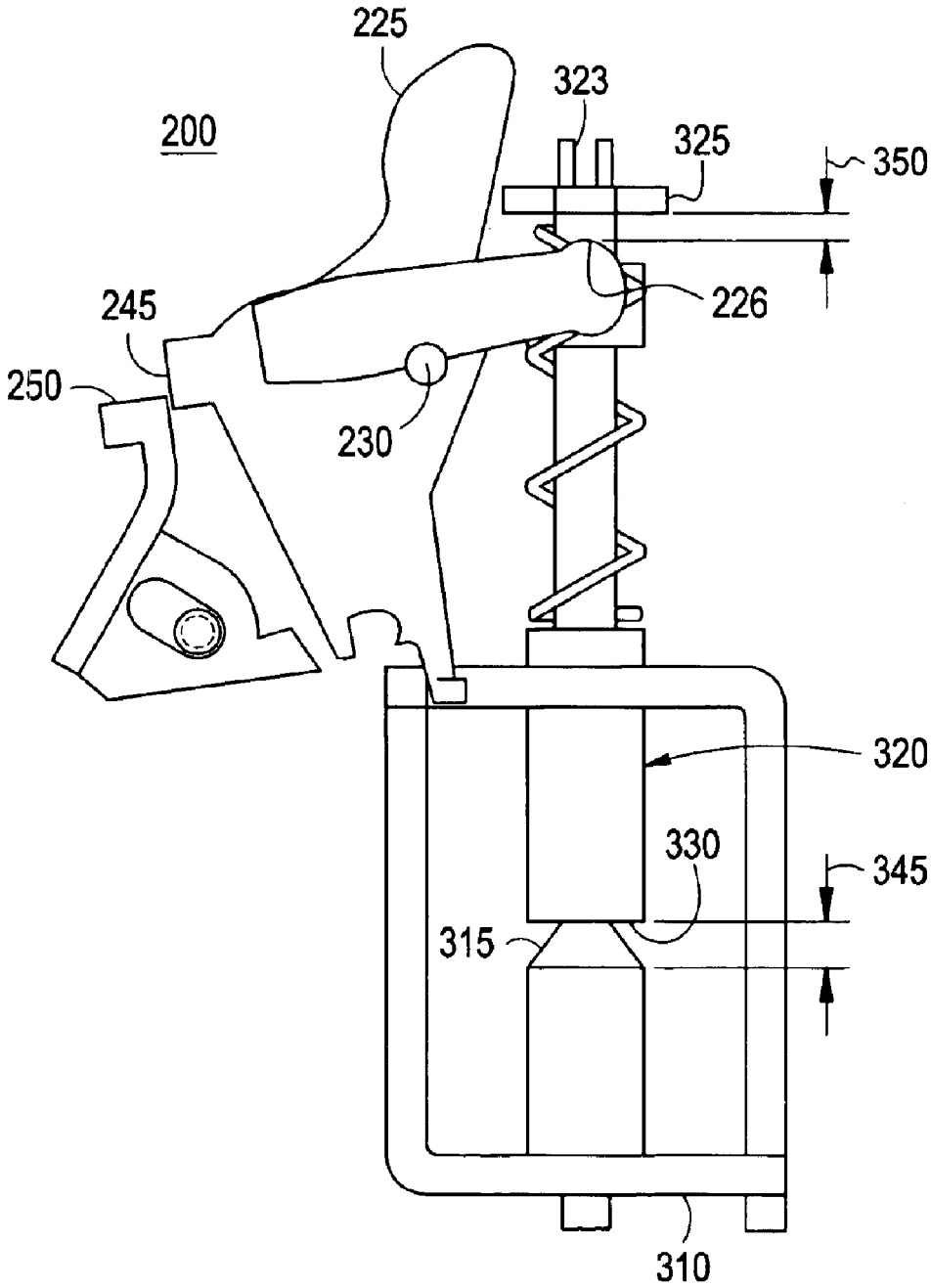
FIG. 3 depicts a side view of selected parts of the trip system of FIG. 2.

Referring now to FIG. 3, which depicts a side view of trip system 200 with some parts omitted for clarity, flux path 310 includes stationary pole face 315 proximate movable pole face 330 of tripping member 320, with a first air gap 345 disposed therebetween. Stationary pole face 315 may be positively conically shaped and movable pole face 330 may be negatively conically shaped, or vice versa, such that one pole face fits into the other, thereby providing an increased surface area for enhanced flux distribution across and lower reluctance at first air gap 345. Trip bar 225 includes a trip surface 226 that interacts with actuator 325 during a tripping action. Disposed between actuator 325 and trip surface 226 is a second air gap 350, which may be adjusted during a calibration routine by rotating tripping member 320 at slotted end 323 to translate actuator 325 up or down, thereby changing the amount of trip stroke required at tripping member 320 for tripping circuit breaker 100. Bias spring 340 biases actuator 325 in a direction (first direction) that tends to increase, or maximize, the dimension of second air gap 350.

Figure 4:
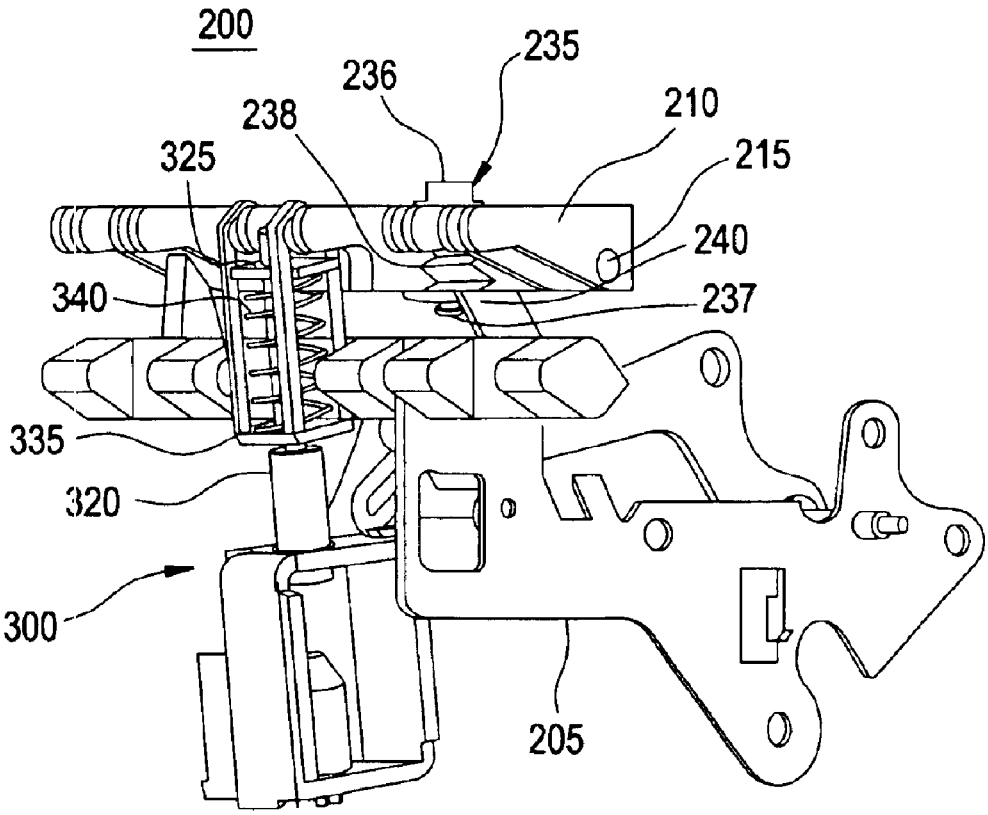
FIG. 4 depicts an alternative isometric view of the trip system of FIG. 2 with some parts removed for clarity.

Referring now to FIGS. 2 and 4, crossbar 210 of trip system 200 includes a trip level adjuster 235, alternatively referred to as an adjustment knob, for adjusting first air gap 345 at trip unit 300, thereby providing a means for adjusting the responsiveness of tripping member 320 of trip unit 300 to the electric current in trip coil 305 and associated magnetic flux in flux path 310. Trip level adjuster 235 includes a first end 236 that may be actuated (in an embodiment rotated) by a user, a second end 237 for rotational engagement with support arm 240 of support frame 205, and a threaded shaft 238, such as a worm gear, that engages with mating threads in crossbar 210. Rotation of trip level adjuster 235 causes crossbar 210 to rotate about pivot 215, which raises or lowers cage 335, bias spring 340, actuator 325, and tripping member 320 in unison, thereby adjusting both first air gap 345 and second air gap 350. During a calibration routine, first and second air gaps 345, 350 are both adjusted together by adjusting (in an embodiment rotating) trip level adjuster 235, and then second air gap 350 is adjusted separately by adjusting (in an embodiment rotating) tripping member 320 at slotted end 323, which causes actuator 325 to translate up or down by way of the threaded engagement discussed previously.

Referring now back to FIG. 3, first air gap 345 defines the amount of downward motion that tripping member 320 may traverse before movable pole face 330 seats against stationary pole face 315, and second air gap 350 defines the amount of downward motion that actuator 325 may traverse before actuator 325 engages trip surface 226 of trip bar 225. Accordingly, and to accommodate the rotation of trip bar 225 about pivot 230 for releasing the secondary latch 245 from the primary latch 250 to effect tripping of circuit breaker 100, second air gap 350 is adjusted to be less than first air gap 345, which provides for sufficient trip stroke at tripping member 320 thereby enabling secondary latch 245 to release from primary latch 250 prior to movable pole face 330 seating against stationary pole face 315.

In view of the foregoing, the responsiveness of trip unit 300 to an electric current and associated magnetic flux may be adjusted by: adjusting both first and second air gaps 345, 350 in unison; adjusting second air gap 350 while maintaining first air gap 345 constant; adjusting second air gap 350 to be less than first air gap 345; and, fixing the second air gap 350 to be constant, by applying an adhesive to the threaded engagement of second end 322 and actuator 325, for example. By employing a common support frame 205 to tightly control the dimensional relationship of parts and assemblies involved in the tripping action of circuit breaker 100, first and second air gaps 345, 350 may be readily adjusted while substantially reducing the trip level variation.

Figure 5:
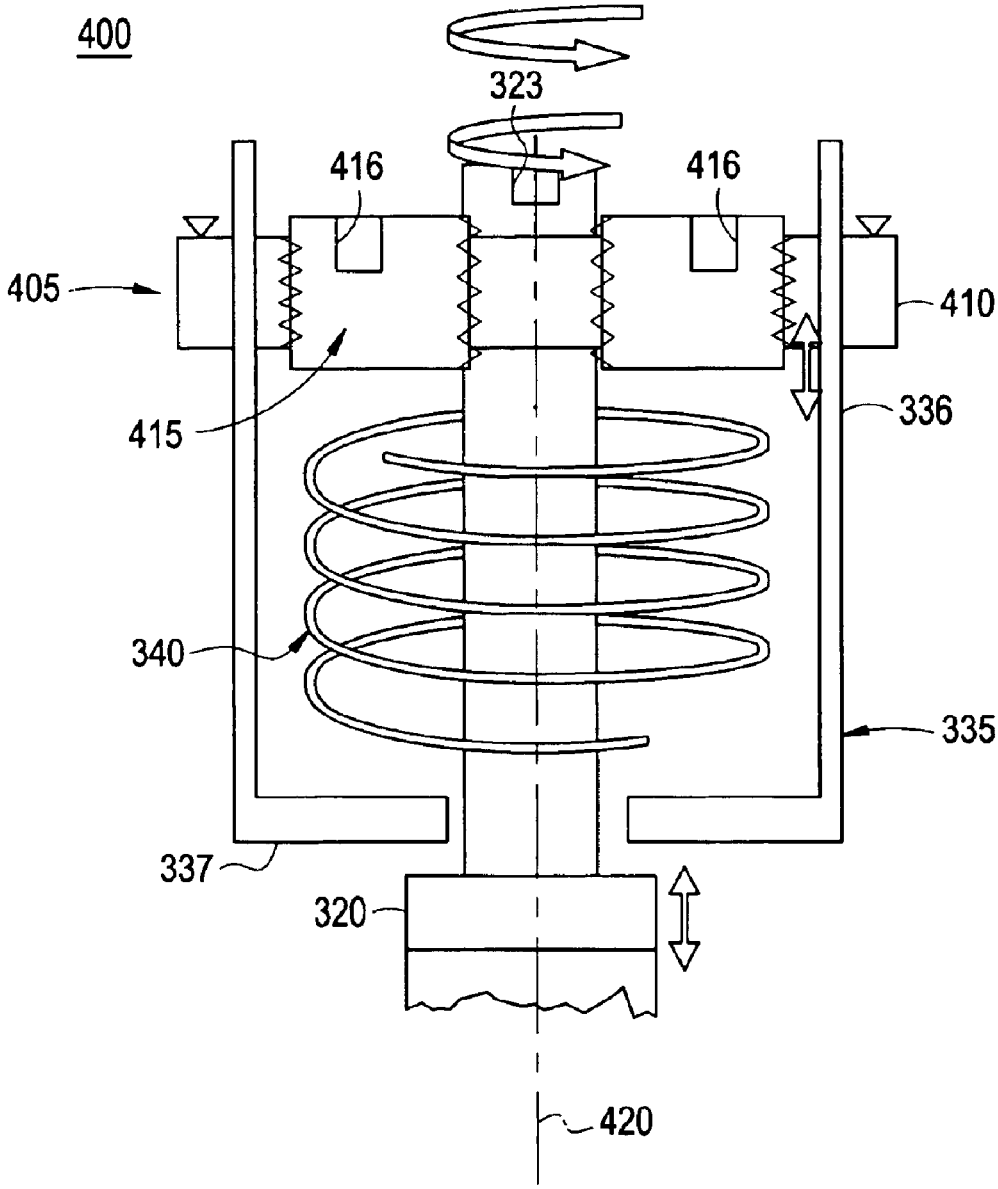
FIG. 5 depicts a section view of an alternative portion of the trip system of FIG. 2.

Referring now to FIG. 5, which depicts an alternative embodiment for providing trip level adjustment and calibration, a calibration system 400, which may be employed in trip unit 300 of FIGS. 2–4, includes cage 335 (alternatively referred to as a retainer), tripping member 320, actuator assembly 405, and bias spring 340 disposed between actuator assembly 405 and bottom section 337 of cage 335 for biasing actuator assembly 405 upward, which is similar to the arrangement depicted in FIGS. 2–4 with actuator assembly 405 replacing actuator 325. Actuator assembly 405 includes an actuator 410 slidably engaged with, or retained by, side legs 336 of cage 335 in a manner similar to that described previously, and a spring adjuster 415 threadably engaged with actuator 410 and tripping member 320 in a manner similar to that described previously. In an embodiment, spring adjuster 415 is disposed between actuator 410 and tripping member 320 in such a manner whereby spring adjuster 415 and tripping member 320 share a common axis 420. Tripping member 320 includes slotted end 323, as discussed previously, for accepting an adjustment tool, such as a spade-tip screwdriver for example, for rotating tripping member 320 about common axis 420, and spring adjuster 415 includes tool receptors 416 for accepting a mating tool for rotating spring adjuster 415 about common axis 420.

For use herein, a combination tool having a central section for engaging slotted end 323 and a peripheral section for engaging tool receptors 416, whereby the central and peripheral sections are separately engagable and rotatable with the respective details 323, 416, is contemplated. Such a tool may be employed in an automated calibration routine.

By rotating spring adjuster 415 while holding actuator 410 and tripping member 320 fixed, spring adjuster 415 can move along common axis 420 in the absence of axial movement of tripping member 320, thereby resulting in a change in the bias force of bias spring 340 without producing a change in the dimension of first air gap 345. Similarly, by rotating tripping member 320 while holding spring adjuster 415 fixed, tripping member 320 can move along common axis 420 in the absence of axial movement of spring adjuster 415, thereby resulting in a change in the dimension of first air gap 345 without producing a change in the bias force of bias spring 340.

In view of the foregoing, trip unit 300 of circuit breaker 100 may be calibrated by: fixing the position of spring adjuster 415 to prevent a change in the bias force at bias spring 340 and therefore a change in trip force; adjusting (in an embodiment rotating) the position of tripping member 320 to change the dimension of first air gap 345 at trip unit 300; fixing the position of tripping member 320 to prevent any further change in the dimension of first air gap 345; fixing the position of actuator 410 to prevent a change in second air gap 350; adjusting (in an embodiment rotating) the position of spring adjuster 415 to change the bias force of bias spring 340 and therefore the trip force. By employing an actuator assembly 405 having separately adjustable tripping member 320 and spring adjuster 415, first air gap 345 and the bias force of bias spring 340 may be separately adjusted independent of the other, thereby providing a greater degree of control during a calibration routine of trip system 200.

As disclosed herein, some embodiments of the invention may include some of the following advantages: adjustability of first and second air gaps 345, 350 with substantial reduction in trip level variation; improved calibration control by having separately adjustable bias force at bias spring 340 and magnetic air gap at first air gap 345; reduced tolerance stack up between moving parts by having a common support frame 205 act as a common datum; ease of assembly through use of modular design with common support frame 205; and, independent control of different calibration parameters.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A trip system for a circuit breaker having a calibration system, the calibration system comprising:

a retainer;

a tripping member responsive to an electric current;

an actuator retained by the retainer with a degree of freedom therebetween;

a spring adjuster adjustably engaged with the actuator and the tripping member; and a bias spring disposed for biasing the actuator in a first direction;

wherein movement of the spring adjuster absent movement of the actuator and the tripping member results in a change in the bias spring force and no change in the position of the tripping member, and movement of the tripping member absent movement of the spring adjuster results in a change in the position of the tripping member and no change in the bias spring force.

2. The trip system of claim 1, wherein:

the spring adjuster is threadably engaged with the actuator and threadably engaged with the tripping member;

the spring adjuster is separately movable in an axial direction in response to it being rotated; and the tripping member is separately movable in an axial direction in response to it being rotated.

3. The trip system of claim 2, further comprising a coil assembly, the coil assembly comprising:

a coil accepting of an electric current and generating a magnetic flux in response thereto; and a flux path proximate the coil and having a stationary pole face;

wherein the tripping member includes a movable pole face disposed at a second end thereof, the movable pole face arranged proximate the stationary pole face;

wherein an air gap is disposed between the stationary pole face and the movable pole face; and wherein the dimension of the air gap is responsive to movement of the tripping member.

4. The trip system of claim 2, wherein the spring adjuster is threadably engaged with the actuator and threadably engaged with the tripping member about a common axis.

5. A trip system for a circuit breaker having a calibration system, the calibration system comprising:

a bias spring for establishing a trip force;

a tripping member responsive to a magnetic flux across an air gap for overcoming the trip force and for generating a trip displacement;

means for adjusting the trip force in the absence of adjustment to the air gap; and means for adjusting the air gap in the absence of adjustment to the trip force.

6. The trip system of claim 5, wherein:

the means for adjusting the trip force comprises means for adjusting a spring adjuster relative to the tripping member; and the means for adjusting the air gap comprises means for adjusting the tripping member relative to the spring adjuster.

7. The trip system of claim 6, wherein the calibration system further comprises:

a retainer; and an actuator retained by the retainer with a degree of freedom therebetween;

wherein the means for adjusting the trip force comprises means for adjusting the spring adjuster relative to the actuator.

8. The trip system of claim 5, wherein the means for adjusting the trip force and the means for adjusting the air gap comprise means for axially adjusting the trip force and the air gap about a common axis.

9. A method for calibrating a trip unit of a circuit breaker, comprising:

fixing the position of a spring adjuster to prevent a change in trip force;

adjusting the position of a tripping member to change the dimension of a first air gap at the trip unit;

fixing the position of the tripping member to prevent any further change in the first air gap;

fixing the position of an actuator to prevent a change in a second air gap at the trip unit; and adjusting the position of the spring adjuster to change the trip force.

10. The method of claim 9, wherein:

the adjusting the position of the tripping member comprises rotating the tripping member; and the adjusting the position of the spring adjuster comprises rotating the spring adjuster.

11. The method of claim 10, wherein:

the rotating the tripping member and the rotating the spring adjuster comprises rotating each about a common axis.

* * * * *